United States Patent [19]

Mirhej

[11] Patent Number: 4,505,867

[45] Date of Patent: Mar. 19, 1985

[54] PROCESS FOR POLYESTER YARNS

[75] Inventor: Michael E. Mirhej, West Chester, Pa.

[73] Assignee: E. I. Du Pont de Nemours and Company, Wilmington, Del.

[21] Appl. No.: 520,008

[22] Filed: Aug. 3, 1983

Related U.S. Application Data

[63] Continuation-in-part of Ser. No. 347,926, Feb. 11, 1982, abandoned.

[51] Int. Cl.[3] ..... B29F 3/08

[52] U.S. Cl. ..... 264/103; 264/176 F; 264/177 F; 264/237

[58] Field of Search ..... 264/103, 176 F, 177 F, 264/171, 237; 425/463, 464

[56] References Cited

U.S. PATENT DOCUMENTS

| | | | |
|---|---|---|---|
| 2,980,492 | 4/1961 | Jamieson et al. | 264/177 F |
| 3,156,085 | 11/1964 | Jamieson | 57/248 X |
| 3,425,893 | 2/1969 | Sims | 57/248 X |
| 3,681,910 | 8/1972 | Reese | 428/373 |
| 4,025,595 | 5/1977 | Mirhej | 264/210.8 |
| 4,110,965 | 4/1978 | Bradley et al. | 57/248 |
| 4,157,419 | 6/1979 | Mirhej | 428/373 |
| 4,233,363 | 11/1980 | Cemel et al. | 428/364 X |
| 4,247,503 | 1/1981 | Venot et al. | 264/168 |
| 4,351,147 | 9/1982 | Blackmon et al. | 264/171 |
| 4,383,817 | 5/1983 | Mirhej | 425/463 |
| 4,419,313 | 12/1983 | Bromley et al. | 264/171 |

FOREIGN PATENT DOCUMENTS

| | | | |
|---|---|---|---|
| 48-23492 | 7/1973 | Japan | 264/103 |
| 52-63417 | 5/1977 | Japan | 264/103 |
| 52-63418 | 5/1977 | Japan | 264/237 |

*Primary Examiner*—Jeffery Thurlow

[57] ABSTRACT

Improvement in a melt-spinning process, so as to prepare a terephthalate polyester yarn containing two types of filaments, one having in cross section not more than one axis of planar symmetry, and being weaker and having a lower elongation at break than the second type of filaments which have a plurality of axes of planar symmetry. The improvement involves spinning the second type through capillaries that are recessed, in relation to those for the first type, and directing quenching air to strike first the filaments of the first type.

19 Claims, 1 Drawing Figure

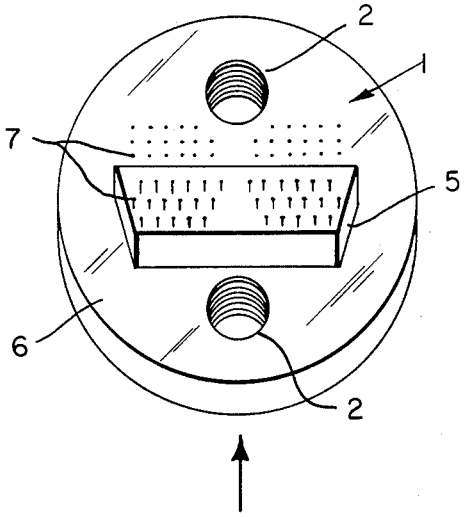
2
1
7
5
6
2

PROCESS FOR POLYESTER YARNS

CROSS-REFERENCE TO RELATED APPLICATION

This application is a continuation-in-part of application Ser. No. 347,926, filed Feb. 11, 1982 now abandoned.

BACKGROUND

This invention relates to an improved melt-spinning process for preparing polyester yarns, the improvement involving the use of a stepped spinneret, whereby there may be prepared polyester yarns that may be draw-textured to produce fabrics having a spun-like feel similar to that of cotton or wool, and polyester yarns that may be air-jet textured to give bulked yarns of interesting properties.

Several suggestions have been made for preparing polyester yarns having a spun-like feel.

It is known to treat polyester yarn in a texturing jet to give it a more natural spun-like feel—see U.S. Pat. No. 4,100,725 to Magel. It is also known to produce filaments having body and wing portions. Filaments in such yarns when treated in a texturing jet tend to split longitudinally so that the wing portions are at least intermittently separated from the body portion. The wing portion also splits transversely giving a product with free ends—see U.S. Pat. No. 4,245,001 to Phillips et al. Mirhej Pat. No. 4,157,419 discloses a polyester draw-texturing feed yarn having three types of filaments, one of which is a bicomponent filament. When this yarn is hot drawn the bicomponent filaments break and the ends form a helical crimp.

Bradley et al U.S. Pat. No. 4,110,965 discloses a process for making a polyester yarn having a spun-like hand by breaking in a false twist operation one type of filaments (nonround filaments) while the second type of filaments (round filaments) remain unbroken. Bradley discloses first melt-spinning poly(ethylene terephthalate) homopolymer at 3400 ypm to form partially oriented round filaments of high denier and nonround filaments of lower denier and of lower elongation, and then draw-texturing at a draw-ratio selected to break no substantial number of filaments prior to passage through a false-twisting device, following which the tension is increased in or after the false-twisting device (using a device, as disclosed in Yu U.S. Pat. No. 3,973,383, for this purpose) so as to break substantially only the lower denier nonround filaments.

Thus, texturing processes, such as draw-texturing and air-jet texturing, exist to develop bulky yarns, and melt-spinning processes have been suggested to prepare mixed yarns whose component filaments will respond differently to the texturing conditions. The resulting textured yarns, however, only approach the spun-like feel of natural fibers, and it would be desirable to improve this quality.

The invention provides an improved process, whereby a mixed yarn of more significantly differing properties can be obtained through a single spinneret, using only a single polymer, if desired, or two polymers, if differential coloring is desired, by effectively providing different extrusion temperatures out of the same spinneret.

SUMMARY OF THE INVENTION

The present invention is broadly described as an improvement in a melt-spinning process for preparing particular mixed multifilament polyester yarns, the improvement characterized by melt-spinning part of the polyester to make filaments of a first type, filaments (a), through a first set of spinneret capillaries whose cross-sections have no more than one axis of symmetry, and the remainder to make filaments of a second type, filaments (b), through a second set of spinneret capillaries that are recessed in relation to those of the first set and whose cross sections have a plurality of axes of symmetry, and by directing a stream of quenching air to strike filaments (a) before filaments (b). By this means is produced a polyester yarn containing at least two different types of filaments. The two types differ in cross-sectional shape. Filaments (a) have no more than one axis of planar symmetry and a nonuniform orientation profile across their cross section, as shown by birefringence. The other type, filaments (b), have a plurality of axes of planar symmetry. In cross section, filaments (b) may be circular or symmetrically multilobal. The polyester of both types of filament may be the same or different, as disclosed, hereinafter, but the two types of filaments differ in physical properties because of this use of the recessed capillaries. The filaments of the second type have a tenacity 30 to 200% higher than the tenacity of the filaments of the first type and an elongation at break at least 30% higher than the filaments of the first type. The yarn contains between about 30% and about 65% filaments of the first type. If desired, the filaments of the second type may be of more than one cross-sectional shape, for example, some may be circular and others symmetrically multilobal.

The same polyester may be used to make both types of filaments (a) and (b). In a first embodiment of the invention, such polyester is a copolymer of poly(ethylene terephthalate) units and ethylene 5-(sodium-sulfo)isophthalate units present in an amount of about 2 mol %, whereby the tenacities are in the ranges: for filaments (a) 0.8 to 2.0 grams per denier, preferably 0.8 to 1.5 grams per denier; and for filaments (b) 1.6 to 3.6 grams per denier, and preferably 1.6 to 2.1 grams per denier. Such yarns are particularly useful as feed yarns for draw-texturing, whereby the resulting yarns may be used in fabrics having a spun-like feel similar to that of cotton or wool.

In a second embodiment of the invention homopolymer of poly(ethylene terephthalate) is used to make both filaments (a) and (b), whereby the tenacities are in the ranges: for filaments (a) 1.0 to 2.2 grams per denier; and for filaments (b) 2.0 to 3.6 grams per denier. Such yarns are particularly useful, when air-jet textured, for giving fabrics of high bulk and good uniformity.

In a third embodiment of the invention, the homopolymer is used for filaments (b), whereby their tenacity is in the range 1.6 to 3.6 grams per denier, preferably 2.0 to 3.6 grams per denier, whereas the same copolymer of the first embodiment is used for filaments (a), whereby their tenacity is in the range 0.8 to 2.0 grams per denier, preferably 0.8 to 1.5 grams per denier. Such yarns are particularly useful for draw-texturing, like those of the first embodiment, hereinbefore, but have an additional characteristic that they may be differentially dyed in the same dyebath, because of the affinity of the two polyester materials to different dyestuffs.

Preferably copolymer filaments (a) have an elongation at break of between about 30% and 100%, and homopolymer filaments (a) have an elongation at break between about 30% and 110%.

A highly desirable cross-sectional shape for filaments (a) is a keyhole shape. This shape will be more fully described in the Examples which will follow.

In the drawing the Figure is of a stepped spinneret suitable for use in the process of the invention.

DETAILED DESCRIPTION

Filaments (a) have in their cross section no more than one axis of planar symmetry. The phrase "no more than one axis of planar symmetry" means that not more than one straight line can be drawn in the plane of the filament cross section that will divide the filament cross section into two equal parts each being the mirror image of the other. Examples of cross sections having no more than one axis of planar symmetry, are a keyhole shape, a triskelion shape, or a fan shape.

Filaments (a) have a nonuniform orientation profile across their cross section, as measured by birefringence, and an overall higher orientation than that of filaments (b). The method of measuring birefringence of textile fibers is disclosed in U.S. Pat. No. 3,963,678 issued to Conrad et al. This nonuniform and higher orientation is purposely created in filaments (b) by the process of the present invention by quenching these filaments more rapidly. These orientation differences between the first and second types of filaments is exploited when using the resulting yarns. For instance, when the first type of filaments are broken in a draw texturing operation, the broken ends twist and curl. These broken ends give the yarn and fabric made from the yarn a "natural" spun feel similar to cotton or wool depending on total number of filaments and average denier per filament. Because the broken ends twist and curl they become somewhat entangled with the other filaments, and as a result there tend to be very few long protruding free ends. Long protruding free ends are partially responsible for the pilling problem in polyester fabrics.

Filaments (b) have a lower overall orientation and a significantly higher elongation at break than the first filaments (a), and also a higher tenacity. Thus when any yarn containing both types of filaments is draw-textured the second filaments just elongate, while some of the first filaments break. The significantly higher elongation property in the second type filaments is "built in" to them by spinning them at a higher temperature, and by attenuating them (drawing them down) at a slower rate over a longer distrance. A preferred means of accomplishing this according to the process of the present invention is by use of the stepped spinneret previously described and shown in the drawing, and the subject of U.S. Pat. No. 4,383,817 also to Mirhej.

The tenacity of the second filaments (b) is also greater than the tenacity of the first filaments (a). A tenacity difference between the second filaments and the first filaments can be expected if the polymer of the first filaments (a) is the copolymer of poly(ethylene terephthalate) and ethylene 5-(sodium-sulfo) is isophthalate, and the second filaments (b) are spun from a polymer that is a homopolymer of about the same melt viscosity as the copolymer. It is well known in the art that such homopolymer filaments are higher in tenacity in grams per denier than copolymer. The second filaments will also have a higher tenacity than the first filaments, even if they are spun from the same chemical composition, if the spinning conditions are properly adjusted. Thus, when using a stepped spinneret, according to a preferred embodiment of the process of the invention, the filaments that are spun cooler and are quenched quicker have lower tenacity than the filaments that are spun hotter and quenched slower. Pilling is also affected by tenacity, in that if tenacity is low, the free ends tend to break off before pills become fully formed—thus shedding the partially formed pill.

In the Examples which follow the relative viscosity was measured in hexafluoro isopropanol, at 25°±0.003° C. at a concentration of 4.75 weight percent and is designated LRV. The birefringence reported is the average of 10 measurements, and the "percent coefficient of variation" is determined by the formula $$\% \text{ Coefficient of Variation} = \frac{\text{Standard Deviation}}{\text{Birefringence Mean}} \times 100.$$

The Figure in the drawing is of a stepped spinneret 1, having mounting holes 2, boss 5 on planar surface 6. Outlet orifices 7 penetrate the boss and the planar surface 6. The arrow shows the preferred direction of flow of quenching air.

Example 1

A spinneret plate of the type illustrated in the Figure had the following dimensions: the plate is approximately 1.25 cm thick having a boss 5 approximately 1.25 cm thick. The boss has about 6.5 cm in its longest dimension, and 1.75 cm wide. The boss has three rows of capillaries, 10 in the first row and 12 in each of the second and third rows. The rows are about 6 mm apart and are offset so that the capillaries in the second when viewed laterally to the length of the row appear to be midway between the capillaries in the first row. The capillaries in the third row are aligned with those in the first row. The capillaries are keyhole shaped about 30 mils (0.76 mm) long, 3 mils (0.076 mm) wide and having an enlarged circular end about 9 mils (0.23 mm) in diameter. The enlargement is located at the end adjacent round capillaries. These capillaries have a circular counterbore on the melt side (the side without the boss) about 0.16 cm in diameter and about 2.3 cm deep. Three additional rows of capillaries which penetrate the spinneret plate in the area not covered by the boss, are located in three lines that are parallel to the rows of capillaries that penetrate the boss. The two rows adjacent the boss contains 12 capillaries, and the other row contains 10 capillaries. These capillaries have a circular counterbore on the melt side (the side without the boss) about 0.16 cm in diameter and about 1 cm deep. The rows are about 1.25 cm apart. These rows of capillaries are not offset. These capillaries are round and have a diameter of approximately 13 mils (0.33 mm). The spinneret plate was mounted on the spinning machine in such a way that the stream of quenching air will first strike the filaments that originate from capillaries that penetrate the boss—the keyhole-shaped capillaries.

Using the above-described spinneret, a polyester yarn was melt-spun from copolyester of poly(ethylene terephthalate) and ethylene 5-(sodium-sulfo) isophthalate, containing about 2 mole percent of the latter component. The copolymer had an LRV of between 14 and 14.5. The polymer contained 0.3% of finely divided $TiO_2$. The block temperature of the spinning machine operated at 300° C. The polymer was spun at 3,200 meters per minute. The filaments were quenched with air having a temperature of 21° C. at an air flow of 65 cubic feet per minute per spinning pack. The flow of the quenching air was such that it first contacted the keyhole filaments and the boss initially shielded the round filaments from the quenching air. Both the filaments having a round cross-sectional shape and the filaments having the keyhole cross-sectional shape had a denier of 4.0. The round filaments had a birefringence of 0.0279. The keyhole filament had a birefringence of 0.0467, and a percent coefficent of variation of 15.4. The round filaments had a break elongation of 146 percent, and the keyhole filaments a break elongation of 88 percent. The round filaments had a tenacity of 2.00 grams per denier, and the keyhole filament had a tenacity of 1.27 grams per denier.

The resulting feed yarn was draw textured on a Leesona® 955 false twist texturing machine at a speed of 91 meters per minute, a twist of 2360 turns per meter at a texturing temperature of 200° C. and a draw ratio of 1.65. The draw textured yarn had 5 broken filaments per centimeter, an elongation at break of 12.6 percent, a tenacity of 1.38 grams per denier and a boiloff shrinkage of 4.8%.

Double knit fabric from this yarn when boiled in an acid bath, pH3, will give an excellent random tumble pill test rating—a rating of 5. The rating schedule is set forth in U.S. Pat. No. 4,157,419 at column 10.

Example 2

Using the same spinning equipment and spinneret as described in Example 1, except that one row of 12 of the keyhole spinneret apertures was blocked, the same copolyester as Example 1 was spun at 295° C. and 3,200 meters per minute. The filaments were quenched with air at 21° C. flowing at 75 cubic ft/min. per spinning pack. The round filaments had a denier of 4.9, a break elongation of 139%, a tenacity of 1.67 grams per denier, a birefringence of 0.0268 with a percent coefficient of variation of 4.5. The keyhole filaments had a denier of 3.4, an elongation at break of 85 percent, a tenacity of 1.17 grams per denier, a birefringence of 0.0686 with a percent coefficient of variation of 23.0.

This yarn was draw textured on the same machine and under the same conditions as the yarn of Example 1, and had a break elongation of 15.0°, a tenacity of 1.83, a boil-off shrinkage of 4.8 and 5.9 broken filaments per centimeter. Double knit poplin fabrics from this yarn when boiled in an acid bath, pH3, will have an excellent random tumble pill test rating.

Example 3

Using the same spinning equipment as in Example 2, including the spinneret with 12 of the keyhole spinneret apertures blocked off, but with the homopolyester of poly(ethylene terephthalate) having an LRV of 22, and containing 0.3% finely divided $TiO_2$ being fed to the round spinneret capillaries, and the copolyester of Example 1 being fed to the keyhole spinneret capillaries, a yarn was spun at 300° C. at a speed of 3,200 meters per minute. The filaments were quenched with air at 21° C. flowing at 75 cubic ft. per minute per spinning pack. The round filament had a denier of 3.5, an elongation at break of 141 percent, tenacity of 2.95 gram per denier and a birefringence of 0.0423 with a coefficient of variation of 7.1. The keyhole-shaped filaments had a denier of 3.2, an elongation at break of 70 percent and a tenacity of 1.07 grams per denier, and a birefringence of 0.0612 with a coefficient of variation of 14.2.

This yarn was draw textured on the same equipment and at the same condition as the earlier examples, except that the draw ratio was 1.55. The textured yarn had an elongation at break of 25.8 percent a tenacity of 3.00 grams per denier, a boil-off shrinkage of 4.1, and 3.3 broken filaments per centimeter. Double knit poplin fabrics of this yarn had acceptable random tumble pill test ratings without boiling in an acid bath, pH3.

Example 4

The spinneret plate used was of the same type and dimensions as in Example 1, except that the boss 5 was approximately 1.92 cm thick; the boss had only two rows of capillaries, 10 in the first row and 12 in the second; each keyhole-shaped capillary had a circular counterbore on the melt side about 3.0 cm deep; and only two additional rows of capillaries penetrated the spinneret plate in the area not covered by the boss, 12 in the row adjacent the boss, and 10 in the other row.

Using the above-described spinneret, a polyester yarn was melt-spun exactly as described in Example 1, except that there was used poly(ethylene terephthalate) of LRV between 20 and 21 (containing 0.3% of finely divided $TiO_2$), and the air flow was 54 cubic feet per minute per spinning pack. Both the filaments having a round cross-sectional shape and the filaments having the keyhole cross-sectional shape had a denier of 3.4. The round filaments had a break elongation of 139 percent, and the keyhole filaments a break elongation of 100 percent. The round filaments had a tenacity of 3.17 grams per denier, and the keyhole filament had a tenacity of 2.17 grams per denier.

The resulting yarn was drawn and air-jet textured and made into knit fabrics that showed high bulk and good uniformity.

I claim:

1. Improvement in a melt-spinning process for preparing a mixed multifilament polyester yarn from a copolymer of poly(ethylene terephthalate) and about 2 mol % ethylene 5(sodium-sulfo)isophthalate units, the improvement characterized by melt-spinning part of the copolymer through a first set of spinneret capillaries whose cross sections have no more than one axis of symmetry and melt-spinning the remainder of the copolymer through a second set of spinneret capillaries that are recessed in relation to those of the first set and whose cross sections have a plurality of axes of symmetry, and by directing a stream of quenching air to strike filaments (a) that have emerged from the first set before filaments (b) that have emerged from the second set, whereby filaments (a) have no more than one axis of planar symmetry and a nonuniform orientation profile across their cross section as shown by birefringence and have a tenacity of 0.8 to 2.0 grams per denier, and filaments (b) have a plurality of axes of planar symmetry, a tenacity of 1.6 to 3.6 grams per denier, and said tenacity is 30 to 200% higher than that of filaments (a), and an elongation at break at least 30% higher than that of filaments (a).

2. The process of claim 1 wherein the tenacity of filaments (a) is 0.8 to 1.5 grams per denier, and the tenacity of filaments (b) is 1.6 to 2.1 grams per denier.

3. The process of claim 1 wherein filaments (a) have an elongation at break of between at least 30% and 100%.

4. The process of claim 1 wherein filaments (a) have a triskelion cross section.

5. The process of claim 1 wherein filaments (a) have a keyhole cross-sectional shape, and filaments (b) have a round cross-sectional shape.

6. The process of claim 1 wherein filaments (b) are multilobal symmetrical.

7. The process of claim 2 wherein filaments (a) have a keyhole cross-sectional shape, and filaments (b) have a round cross-sectional shape.

8. Improvement in a melt-spinning process for preparing a multifilament mixed polyester yarn from poly(ethylene terephthalate) homopolymer and from a copolymer of poly(ethylene terepthalate) and about 2 mol % of ethylene 5(sodium-sulfo) isophthalate units, the improvement characterized by melt-spinning the copolymer through a first set of spinneret capillaries whose cross sections have no more than one axis of symmetry and melt-spinning the homopolymer through a second set of spinneret capillaries that are recessed in relation to those of the first set and whose cross sections have a plurality of axes of symmetry, and by directing a stream of quenching air to strike filaments (a) that have emerged from the first set before filaments (b) that have emerged from the second set, whereby filaments (a) have no more than one axis of planar symmetry and a nonuniform orientation profile across their cross section as shown by birefringence and have a tenacity of 0.8 to 2.0 grams per denier, and filaments (b) have a plurality of axes of planar symmetry, a tenacity of 1.6 to 3.6 grams per denier, and said tenacity is 30 to 200% higher than that of filaments (a), and an elongation at break at least 30% higher than that of filaments (a).

9. The process of claim 8 wherein the tenacity of filaments (a) is 0.8 to 1.5 grams per denier, and the tenacity of filaments (b) is 2.0 to 3.6 grams per denier.

10. The process of claim 8 wherein filaments (a) have an elongation at break of between at least 30% and 100%.

11. The process of claim 8 wherein filaments (a) have a triskelion cross section.

12. The process of claim 8 wherein filaments (a) have a keyhole cross-sectional shape, and filaments (b) have a round cross-sectional shape.

13. The process of claim 8 wherein filaments (b) are multilobal symmetrical.

14. The process of claim 9 wherein filaments (a) have a keyhole cross-sectional shape, and filaments (b) have a round cross-sectional shape.

15. Improvement in a melt spinning process for preparing a mixed multifilament polyester yarn from poly(ethylene terephthalate) homopolymer, the improvement characterized by melt-spinning part of the homopolymer through a first set of spinneret capillaries whose cross sections have no more than one axis of symmetry and melt-spinning the remainder of the homopolymer through a second set of spinneret capillaries that are recessed in relation to those of the first set and whose cross sections have a plurality of axes of symmetry, and by directing a stream of quenching air to strike filaments (a) that have emerged from the first set before filaments (b) that have emerged from the second set, whereby filaments (a) have no more than one axis of planar symmetry and a nonuniform orientation profile across their cross section as shown by birefringence and have a tenacity of 1.0 to 2.2 grams per denier and filaments (b) have a plurality of axes of planar symmetry, a tenacity of 2.0 to 3.6 grams per denier, and said tenacity is 30 to 200% higher than that of filaments (a), and an elongation at break at least 30% higher than that of filaments (a).

16. The process of claim 15 wherein filaments (a) have an elongation at break of between at least 30% and 110%.

17. The process of claim 15 wherein filaments (a) have a triskelion cross section.

18. The process of claim 15 wherein filaments (a) have a keyhole cross-sectional shape, and filaments (b) have a round cross-sectional shape.

19. The process cf claim 15 wherein filaments (b) are multilobal symmetrical.

* * * * *